United States Patent [19]

Wiedemann et al.

[11] 4,040,570

[45] Aug. 9, 1977

[54] PREPARATION OF UNIFORM BLACK POWDER GRANULES

[75] Inventors: Wolfgang Wiedemann, Dulmen; Friedrich Platte, Recklinghausen, both of Germany

[73] Assignee: Wasag Chemie GmbH, Munich, Germany

[21] Appl. No.: 595,221

[22] Filed: July 11, 1975

Related U.S. Application Data

[63] Continuation of Ser. No. 281,622, Aug. 18, 1972, abandoned.

[30] Foreign Application Priority Data

Aug. 31, 1971 Germany ..... 2143443

[51] Int. Cl.[2] ..... B02C 19/12

[52] U.S. Cl. ..... 241/3; 241/29

[58] Field of Search ..... 241/248, 3, 29, 159, 241/244, 259.1, 259.3, 261.1; 23/266

[56] References Cited

U.S. PATENT DOCUMENTS

| | | | |
|---|---|---|---|
| 1,017,286 | 2/1912 | DuPont | 425/327 |
| 1,523,478 | 1/1925 | Fischer | 241/248 X |
| 2,763,440 | 9/1956 | Johnson | 241/248 X |
| 3,690,573 | 9/1972 | Kueneman | 241/207 |
| Re. 10,965 | 10/1888 | Oliver | 241/159 X |

*Primary Examiner*—Granville Y. Custer, Jr.
*Attorney, Agent, or Firm*—Hammond & Littell

[57] ABSTRACT

Apparatus and method for producing black powder granules of a given grain size by compressing black powder meal, subjecting the compressed black powder to coarse crushing and grinding the coarse crushed black powder in a cone mill.

2 Claims, 1 Drawing Figure

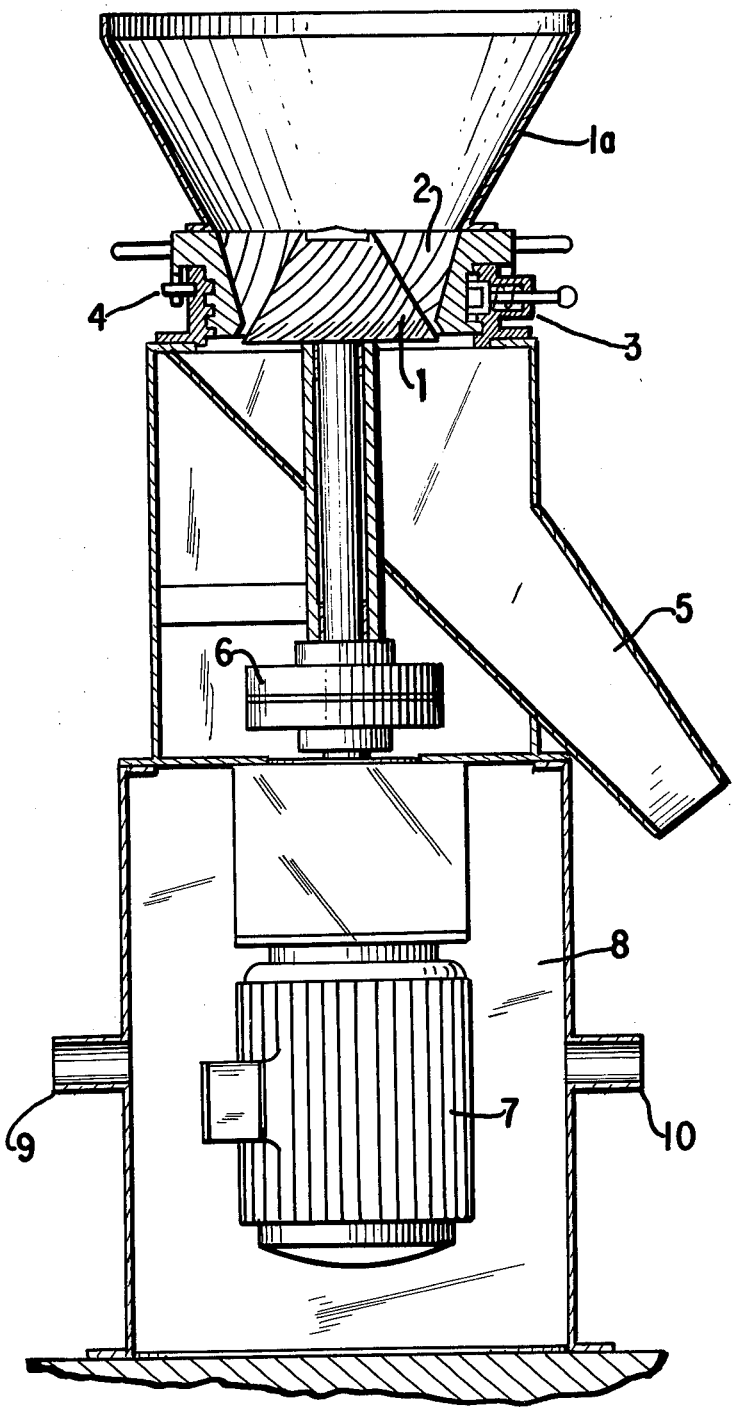
1a
2
4
3
1
5
6
8
7
9
10

PREPARATION OF UNIFORM BLACK POWDER GRANULES

PRIOR APPLICATION

This application is a continuation of our copending, commonly assigned U.S. patent application Ser. No. 281,622 filed Aug. 18, 1972, now abandoned.

STATE OF THE ART

The known method for producing black powder granules of a given size comprises compressing the black powder dust or meal consisting of potassium nitrate, sulfur and carbon, coarse crushing the compressed black powder with a crusher and grinding the crushed black powder in a roller mill which normally consists of three pairs of rollers which have progressively narrow gaps from the charging end to the finish end with a connecting conveyer bottom. The grinding is thereby effected so that the coarse crushed, compressed black powder is ground in steps as it passes through each pair of rollers which results in the formation of a relatively high proportion of black powder meal which must be recycled. The yield of useable black powder of the so-called good grain is relatively low per pass.

The stepwise grinding has been employed because the gap of a pair of rollers can be made narrower than the gap of the preceding pair of rollers only by a certain amount to enable feeding a relatively large amount of material into the roller gaps without jamming. When it is desired to change the grain size of the final black powder, major adjustments are necessary because of the series connection of the several roller pairs or several preset rollers mills must be provided to obtain black powder of different grain sizes.

Another disadvantage of the known method is the large amount of floor space required if several different roller mills are installed and even if a single roller mill with several conventional roller pairs is used. The use of automatic production lines of black powder has been prevented by this disadvantage and the further drawbacks of need for an additional lift conveyor for the feed material because of the great height difference between the imput point and the output point of the roller mills of conventional design and the relatively complicated drive mechanism.

OBJECTS OF THE INVENTION

It is an object of the invention to provide a novel method of obtaining good yields per pass of black powder of good grain size.

It is another object of the invention to provide a novel apparatus for obtaining black powder in various grain sizes in a continuous fashion.

These and other objects and advantages of the invention will become obvious from the following detailed description.

THE INVENTION

The novel method of the invention for the preparation of black powder of a given grain size comprises compressing black powder dust, coarse crushing of the compressed black powder and grinding of the coarse crushed black powder in an adjustable cone mill for continuous variation of grinding fineness to obtain a uniform grain size black powder.

In contrast to the known methods there is no forced grinding in the method of the invention wherein the compressed, coarsely crushed black powder is broken into granules. Experience has shown that this reduces the dust portion of the granulated material that must be recycled for compression and this is achieved so that the material to be granulated is broken by way of the least resistance without the detachment of large amounts of small particles. There is hardly any relative movement of the material relative to each other during introduction into the conical gap and there is therefore no abrasion prior to the grinding. The simple adjustment by varying the conical gap permits grinding into any desired size and change to another size after the production of a certain required amount of black powder of a given size is possible at any time without stopping by suitable remote control means from a central control tower. This possibility, as well as the small difference in height between input and output points and the compact design of the cone mill permit the use of the method in automatic or continuous production lines for black powder at relatively low cost.

The process of the invention for grinding black powder uses a cone mill having a grinding mechanism consisting of a conical, spirally grooved rotor and conical, oppositely spirally grooved stator continuously adjustable for variation of the grinding fineness, index means to read the respective gap width, the rotor and stator being made of non-sparking materials for reasons of safety, the adjustable stator having a stop means to prevent any possible contact with the rotor, and safety clutch means arranged between the rotor of the grinding gear and the drive means to prevent overload by the action of foreign bodies, the drive means being arranged in a dust-proof, separately ventilated housing beneath the grinding gear.

Referring now to the drawing,

FIG. 1 illustrates a cone mill which may be used in connection with a compressing means and a coarser crushing means in the method of the invention.

The cone mill of FIG. 1 is comprised of cone 1*a* which encompasses rotor 1 and adjustable conical stator 2 which is spirally grooved. The stator 2 can be raised and lowered relative to the rotor 1 by the cam threads on cylinder 3 which includes indicator means 3*a* to show the height of stator 2 whereby the gap width can be read, lock means 4 prevents contact with the rotor during operation and the ground black powder is recovered by discharge means 5. The spirally grooved rotor 1 is connected through safety clutch means 6 to a drive means 7 which is preferably an electric motor. The drive means 7 is arranged in a dust-proof housing 8 to prevent explosion which is separately ventilated by air entering the housing 8 through intake 9 and exiting through exhaust 10.

Various modification of the method and apparatus of the invention may be made without departing from the spirit or scope thereof and it should be understood that the invention is to be limited only as defined in the appended claims.

We claim:

1. A method for the production of black powder granules of a given uniform grain size comprising compressing black powder meal, coarse crushing the compressed black powder and grinding the coarse ground black powder particles with little relative movement of the particles to each other in a gap between a conical, spirally grooved rotor and a conical, oppositely spirally grooved stator.

2. The method of claim 1 in which the said gap is continuously adjustable for variation of grinding fineness.

* * * * *